US005560157A

United States Patent [19]

Rotter

[11] Patent Number: 5,560,157

[45] Date of Patent: Oct. 1, 1996

[54] FASCIA VENT

[76] Inventor: Martin J. Rotter, 115 Lismore Ave., Glenside, Pa. 19038

[21] Appl. No.: 306,554

[22] Filed: Sep. 14, 1994

[51] Int. Cl.[6] ..... E04B 7/00

[52] U.S. Cl. ..... 52/95; 52/199; 52/302.1; 454/260

[58] Field of Search ..... 52/95, 199, 303, 52/302.3; 454/260, 35, 37

[56] References Cited

U.S. PATENT DOCUMENTS

| | | | |
|---|---|---|---|
| 255,608 | 3/1882 | Eaton | 454/260 X |
| 340,570 | 4/1886 | Gilman | 454/260 X |
| 2,885,942 | 5/1959 | Horst | 454/260 |
| 2,954,727 | 10/1960 | Katt et al. | 454/260 |
| 3,256,654 | 6/1966 | Pinckney, Jr. | 52/95 |
| 3,378,676 | 3/1968 | Dunnington et al. | 454/260 |
| 3,683,785 | 8/1972 | Grange | 98/35 |
| 3,972,164 | 8/1976 | Grange | 52/95 |
| 4,007,672 | 2/1977 | Luckey | 52/95 X |
| 4,607,566 | 8/1986 | Bottomore et al. | 98/37 |
| 4,807,409 | 2/1989 | Sells | 52/95 |
| 5,035,172 | 7/1991 | Waggoner | 454/260 |
| 5,092,225 | 3/1992 | Sells | 454/365 |
| 5,167,579 | 12/1992 | Rotter | 454/365 |
| 5,207,033 | 5/1993 | Sells | 52/14 |
| 5,292,281 | 3/1994 | Butler | 454/260 |
| 5,328,406 | 7/1994 | Morris, Jr. et al. | 52/95 X |

*Primary Examiner*—Carl D. Friedman
*Assistant Examiner*—David J. Jersen
*Attorney, Agent, or Firm*—Panitch Schwarze Jacobs & Nadel, P.C.

[57] ABSTRACT

A building structure adapted allows for ventilation of vapors from within the structure so as to retard deterioration of the structure. The building structure has a roof extending over one or more vertical side walls. An attic space is enclosed between the roof and an internal ceiling. The roof is constructed on a plurality of parallel rafters. The rafters are supported by a top plate capping each vertical side wall. The roof has a roof sheathing member overlying the roof rafters. A fascia is secured to the outer ends of the roof rafters and at least one portion of the fascia is spaced from the outer ends of the rafters. An air permeable and resilient strip is interposed between the fascia and the outer ends of the rafters to provide for the flow of vapor therebetween and into the attic.

19 Claims, 7 Drawing Sheets

FIG. 3
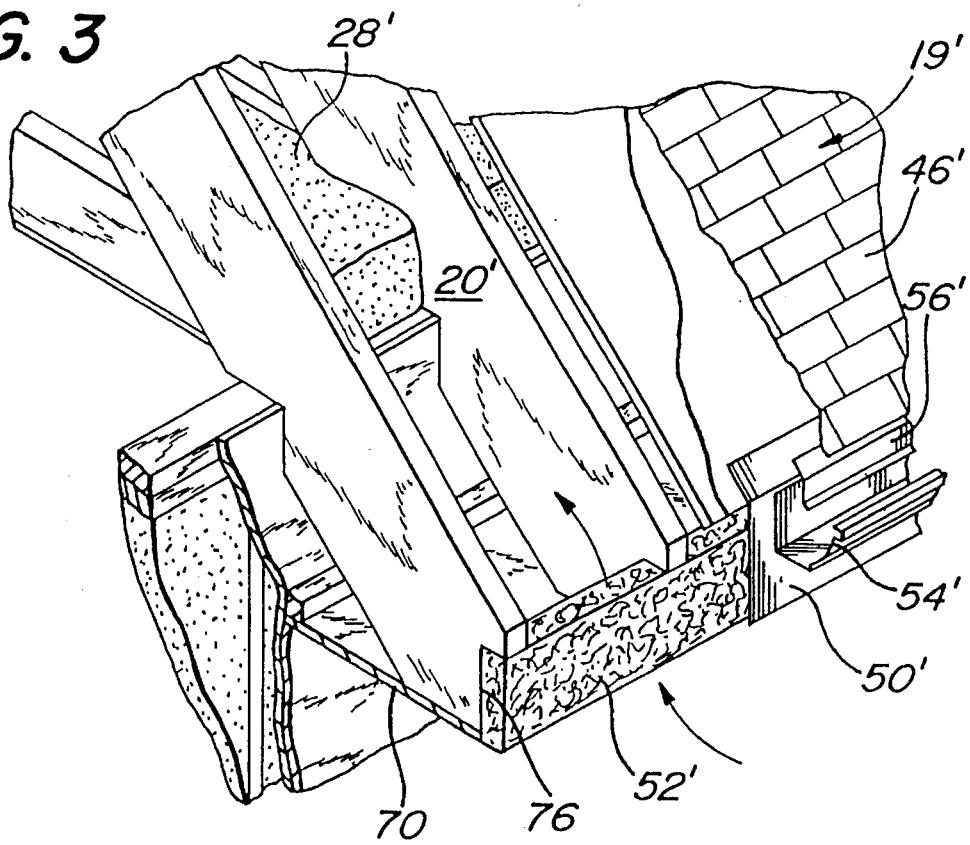
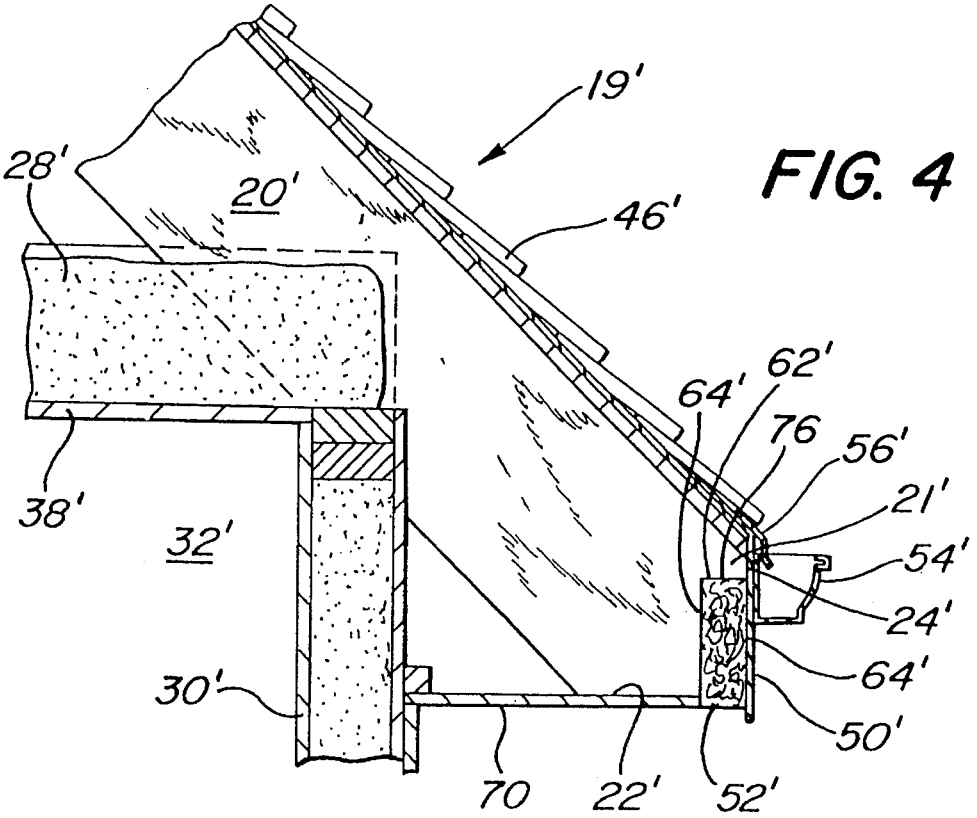
FIG. 4

FASCIA VENT

FIELD OF THE INVENTION

This invention relates generally to the field of roof construction and methods of making roofs and, more particularly, to a roof construction having a fascia spaced from the roof rafter by an air-permeable and resistant strip to allow air circulation into an attic from between the fascia and the roof rafter.

BACKGROUND OF THE INVENTION

It has been a long known practice to ventilate attics under gable roofs by the use of soffit ventilators. Soffit ventilators are perforated or louvered vent openings in the underside, or soffit, of the eaves of an overhanging roof. The vents allow fresh ambient air to flow into the attic to equalize interior temperature and pressure with the outside. This equalization inhibits moisture from condensing on insulation and wood roofing materials, prevents buildup of ice dams which could buckle shingles and gutters, and reduces air-conditioning costs when hot attic air is replaced by cooler ambient air.

A soffit ventilator system may work in conjunction with a passive roof vent, such as a ridge vent, or with a forced-air fan to provide positive ventilation. As hot stale air is withdrawn through the roof vent by convection, wind suction, and/or forced flow, it is replaced by fresh ambient air through the soffit vents.

However, in construction where there is no soffit or a very narrow soffit with no vent openings, or the use of a soffit vent would adversely affect the building's exterior appearance which outweighs the benefit of installing vent openings, for example a historic building, an alternative method is required.

It is thus desired to have a roof construction that allows for ventilation and fresh air flow through the attic without the need for a soffit or cutting vent holes into a soffit.

SUMMARY OF THE INVENTION

The present invention provides a building structure adapted to allow for ventilation of vapors from within the structure so as to retard deterioration of the structure. The building structure has a roof extending over one or more vertical side walls. An attic space is enclosed between the roof and an internal ceiling. The roof is constructed on a plurality of parallel rafters. The rafters are supported by a top plate capping each vertical side wall. The roof has a roof sheathing member overlying the roof rafters. A fascia is secured to the outer ends of the roof rafters and at least one portion of the fascia is spaced from the outer ends of the rafters. An air permeable and resilient strip is interposed between the fascia and the outer ends of the rafters to provide for the flow of vapor therebetween and into the attic.

In a preferred embodiment, the outer ends of the roof rafters overlie the top plate. In this preferred embodiment, the building structure has no soffit and the air permeable and resilient strip is adjacent the sill plate.

In an alternative preferred embodiment, a soffit is interposed between the top plate and the fascia and underlies the roof rafters. In this embodiment, the air permeable and resilient strip is interposed between the soffit and the fascia and provides ventilation without disturbing the aesthetic of the soffit.

Further objects, features and advantages of the present invention will become more apparent to those skilled in the art as the nature of the invention is better understood from the accompanying drawings and detailed description.

BRIEF DESCRIPTION DRAWINGS

For the purpose of illustrating the invention, the drawings show a form which is presently preferred; it being understood, however, that this invention is not limited to the precise arrangements and instrumentalities shown.

FIG. 3 is a perspective view of an alternative embodiment of a conventional housing structure having a soffit and showing the relationship of the air permeable and resilient strip in a fascia ventilation system of the present invention;

FIG. 4 is a vertical section of a portion of a house similar to FIG. 2 showing the alternative embodiment of FIG. 3;

DESCRIPTION OF THE PREFERRED EMBODIMENT

Figure 1:
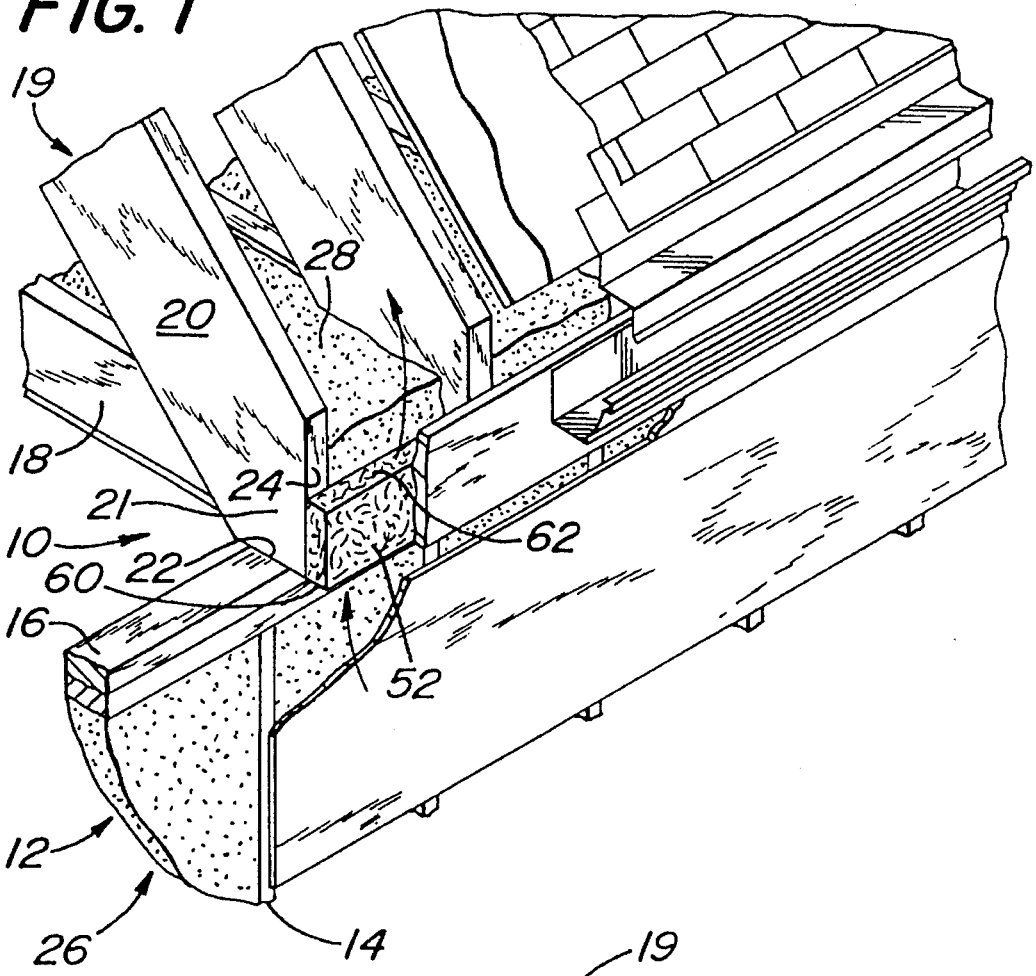
FIG. 1 is a perspective view of a house showing the invention in relationship to elements of a conventional housing structure.

Referring to the drawings in detail, wherein like numerals indicate like elements, and primes ("and") indicate counterparts of such elements, FIG. 1 illustrates a building structure 10 according to the invention.

In the depicted embodiment, the building structure 10 has a wood frame 12, which is built of wall studs 14 capped by a double-sill top plate 16, ceiling joists 18, and roof rafters 20. The ceiling joists 18 span across the structure from the top plate 16, and the rafters 20 extend upward at a pitch of between ⅙ and ⅓, expressed as the ratio of the rise to the total span. Note that in this construction, each rafter has its lower end cut to form a horizontal edge 22, which rests on the top plate 16, and a vertical edge 24 which extends only slightly beyond the top plate. Thus, there is little or no eave.

Figure 2:
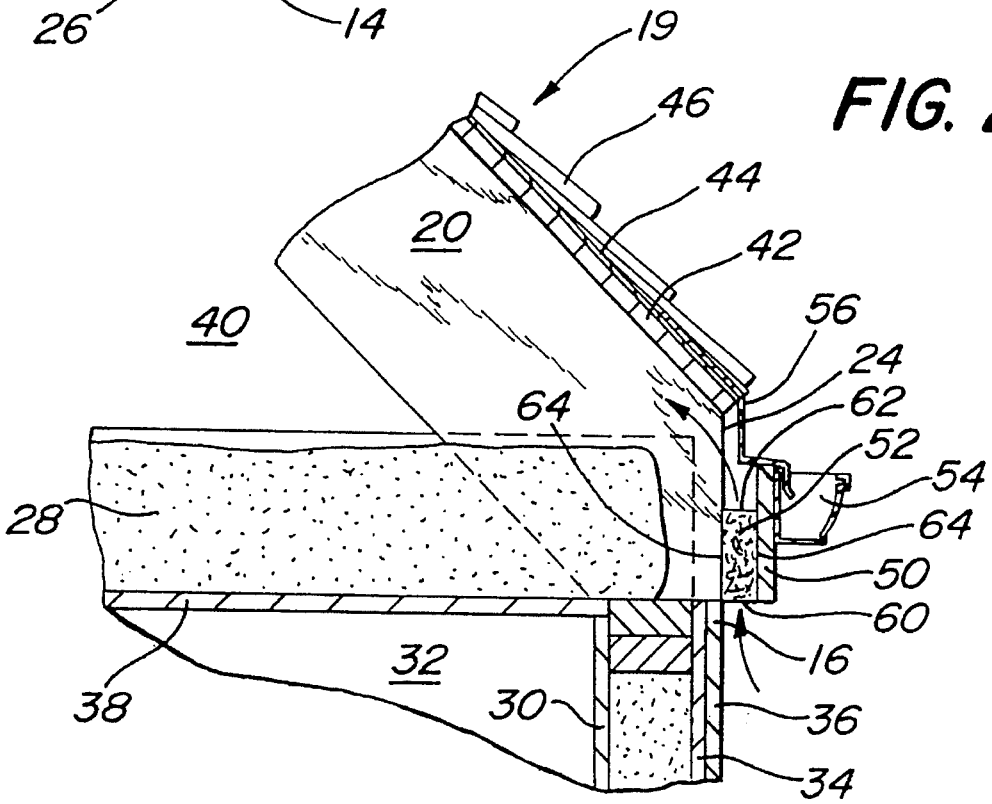
FIG. 2 is a vertical section of a portion of a house showing the relationship of the air permeable and resilient strip according to the present invention.

The studs 14 and top plate 16 frame the vertical walls 26. Referring to FIG. 2, the vertical wall 26 is finished by a plaster wall 30 enclosing an interior 32 of the building, and an outer sheathing 34 covered by siding 36.

A ceiling 38 underlying the ceiling joist 18 divides the interior 32 from an attic 40. A batten-type insulation 28 is laid between the ceiling joists 18. Plywood roof sheathing 42 overlies the roof rafter 20, with roofing paper 44 and shingles 46 covering sheathing 42. In conventional construction of building structures of this type, the structure has a board or boards secured to the vertical edge 24 of the rafters, called an eave fascia, or simply the fascia 50.

In the present invention, an air permeable resilient strip 52 is sandwiched between the vertical edge 24 of the roof rafters and the fascia 50 allows for soffit ventilation of the attic in building structures that have little or no eave, and therefore essentially no soffit area.

The fascia 50 and the air permeable and resilient strip 52 are secured to the rafters by fasteners extending through the fascia 50 and strip 52 into the vertical edge 24 of the roof rafters 20. As seen most clearly in FIG. 2, the air permeable and resilient strip 52 has a lower surface 60 that is exposed to outside ambient air to allow air flow, and an upper surface 62 and side surfaces 64 through which the air can flow. The air enters from the outside through the lower surface 60 of the air permeable and resilient strip and flows through the strip 52 to the upper surface 62. Depending on the height of the insulation 28 (typically 6 inches), or how far the insulation 28 extends outward onto the top plate 16, the side surface 64 of the strip 52 may extend upward beyond the insulation 28 or be spaced from the insulation 28. The air flows upward in the attic and is discharged through the vent at the ridge of the roof, or gable vents (not shown).

A rain gutter 54 is secured to the fascia 50, and a drip edge 56 underlies the shingles 46 at the lower outer end of the roof sheathing 42, projecting over the fascia 50 and into the rain gutter 54.

In a preferred embodiment, the non-woven air permeable and resilient strip 52 is formed of individual strips 3 inches wide and 50 feet long with a thickness of 1 or 1½ inches. The strip 52 can be manufactured in various colors to blend with the fascia 50 and/or the siding 36. The non-woven air permeable and resilient strip 52 is made of synthetic fibers (usually nylon or polyester) which are opened and blended, then randomly aligned into a web by an airflow. The web is treated with bonding agents of water-based phenolics and latexes. The treated web is then oven-cured to bind the fabrics into a relatively rigid mat having a significant porous area between these random fibers. U.S. Pat. No. 5,167,579 describes such an air permeable and resilient material or member being used in conjunction with a ridge vent and is incorporated herein by reference.

Method of Installation

The fascia vent can be installed on new construction before the fascia is installed, or in renovating a pre-existing building structure by first removing the existing fascia boards 50 from the roof rafters 20. With the fascia 50 not installed, the lower surface 60 of the air permeable and resilient strip 52 is placed flush with the bottom of the ceiling joist 18 and the horizontal edge 22 of the roof rafters 20 with the strip 52 extending 3 inches upward.

With the strip 52 held in place either by hand, adhesive or nails, the fascia 50 is then placed and secured by driving fasteners through the fascia and strip 52 into the vertical edge 24' of the roof rafters 20. The rain gutter 54 and drip edge 56 are installed in a conventional manner afterwards, with the shape of the drip edge 56 fashioned to conform with the movement outboard of the fascia 50.

Alternative Embodiment

Referring to FIGS. 3 and 4, a second preferred embodiment is shown for a building structure of the type which has roof eaves, and thus both a soffit 70 and a fascia 50'.

The roof rafters 20' each have a lower outer end 21' which is cut to form a horizontal edge 22' and a vertical edge 24'. In conventional construction of this style roof, the soffit 70 underlies and is secured to the horizontal edge 22' of the roof rafters 20'. The fascia 50' in this illustration is a metal plate and is secured to the vertical edge 24' of the roof rafters 20'.

In this embodiment, similar to the first embodiment, the insulation 28' is located between the ceiling joists 18' and ends above the top plate 16'. The drip edge 56' underlies the shingles 46' at the lower end of the roof sheathing 42', projects over the fascia 50' and into the rain gutter 54'.

In this type of structure using the present invention, an air permeable and resilient strip 52' is located in proximity to the fascia 50' in a notch 76 cut in each of the roof rafters 20'. The air enters from the outside through the lower surface 60' of the air permeable and resilient strip 52' and flows through the strip 52' to both the upper surface 62' and the side surface 64'. Unlike conventional soffit vents where insulation 28' could fall into the area above the soffit 70 and block the vent, if insulation 28' falls into the area above the soffit 70 in this invention, the insulation 28' will not block the ventilation.

The strip 52' is colored to blend with the fascia 50 or soffit 70. The air flow is shown by the arrows to ventilate the building.

Method of Installation

Similar to the first embodiment, the fascia vent can be installed on new construction before the fascia 50' is installed, or in renovating a pre-existing building structure by first removing the existing fascia boards 50' from the roof rafters 20'.

Each rafter 20' is cut to form a notch 76 of the same height as the width of the resilient strip 52' and of the same depth as the thickness of the strip 52'. The strip 52' is set into the notches 76 and tacked by nail or adhesive to a few rafters to hold it in position. The lower surface 60 of the air permeable and resilient strip is placed flush with the bottom of the ceiling joist 18 and the horizontal edge 22' of the roof rafters 20' and extends upward in the notch 76. The fascia 50' is then placed and secured by driving fasteners through the fascia 50' and strip 52' into the vertical edge 24' of the roof rafters 20'.

In typical renovation, the gutter 54' and the drip edge 56' are also removed in order to facilitate the cutting of the notch 76 in the rafters 20' and then reinstalled.

Alternative Embodiments

Figure 5:
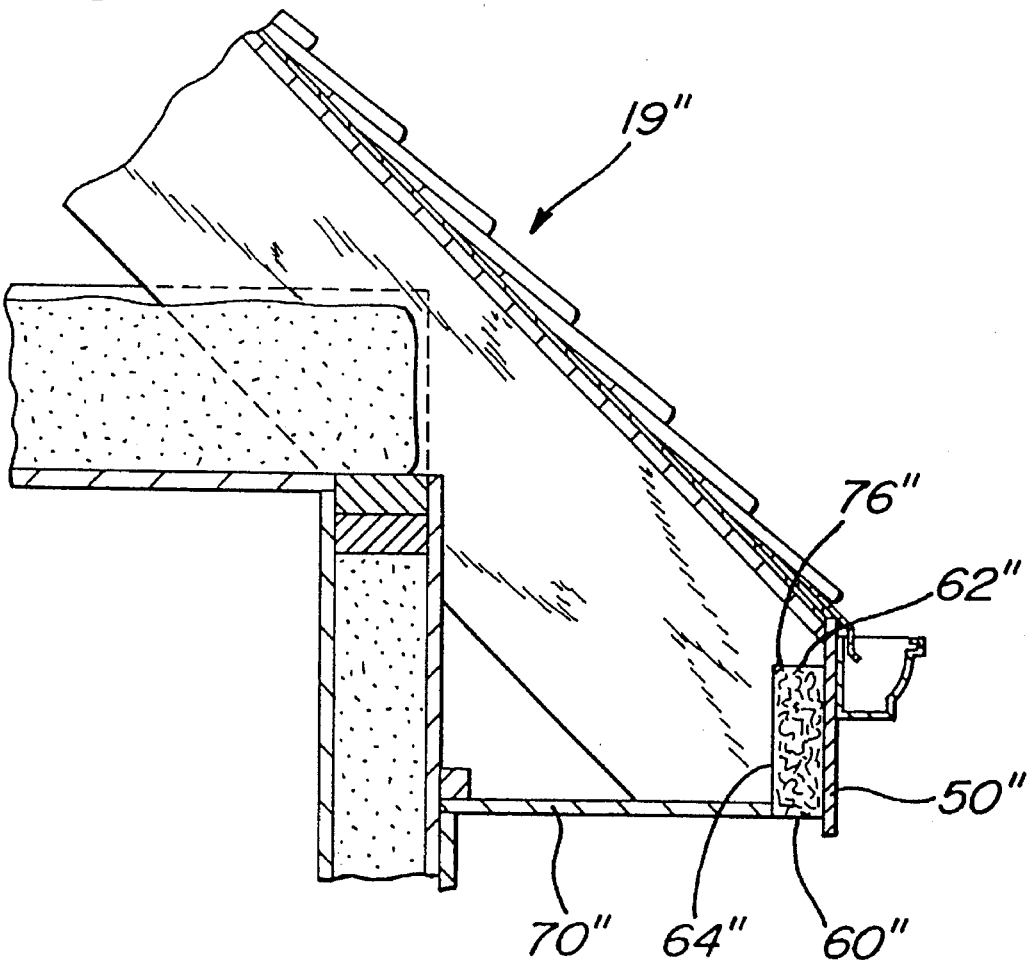
FIG. 5 is a vertical section of a portion of a house similar to FIG. 4 showing an alternative fascia.

Referring to FIG. 5, a third embodiment is shown for a building structure of the type having a soffit 70" and a wooden fascia 50". The fascia 50" is wooden similar to the first embodiment and is secured by conventional means. An air permeable and resilient strip 52" is located in proximity to the fascia 50" in a notch 76" cut or formed in each of the roof rafters 20". The air enters from the outside through the lower surface 60" of the air permeable and resilient strip 52" and flow through the strip 52" to both the upper surface 62" and the side surface 64".

Figure 6:
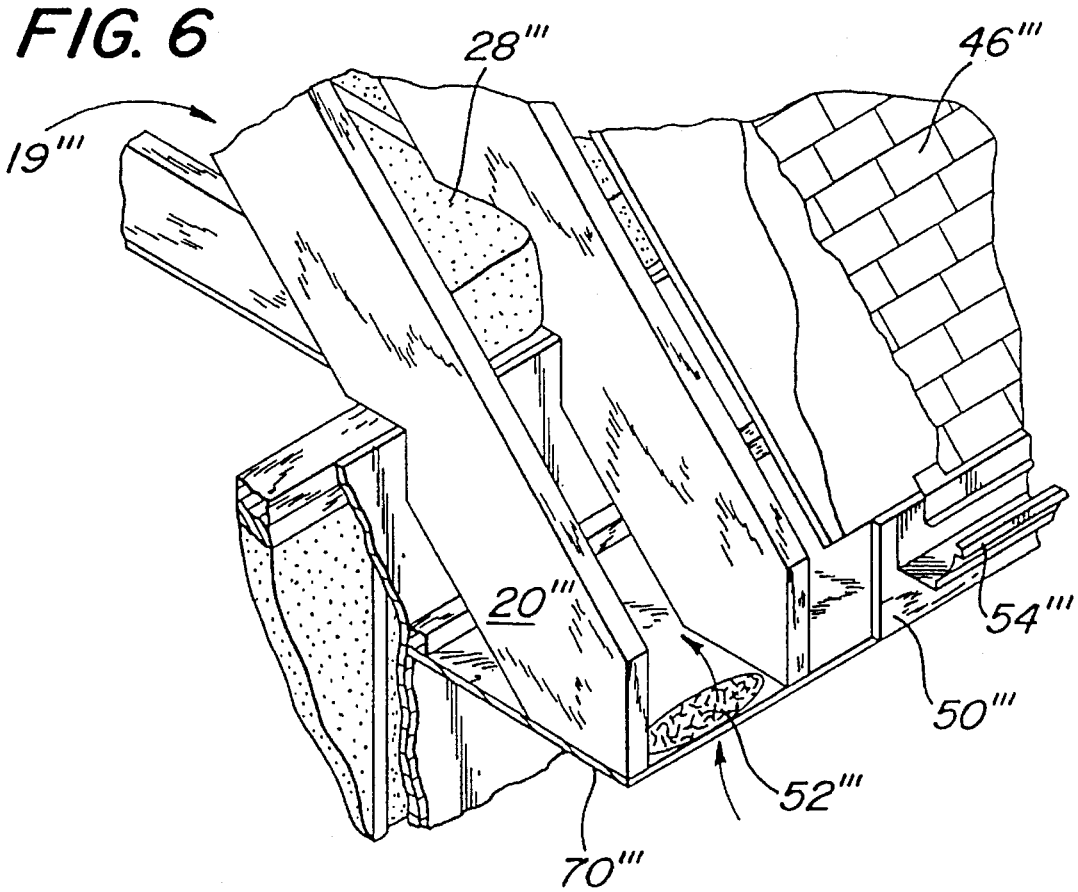
FIG. 6 is a perspective view of the house showing a third alternative embodiment of the air permeable and resilient strip.
Figure 7:
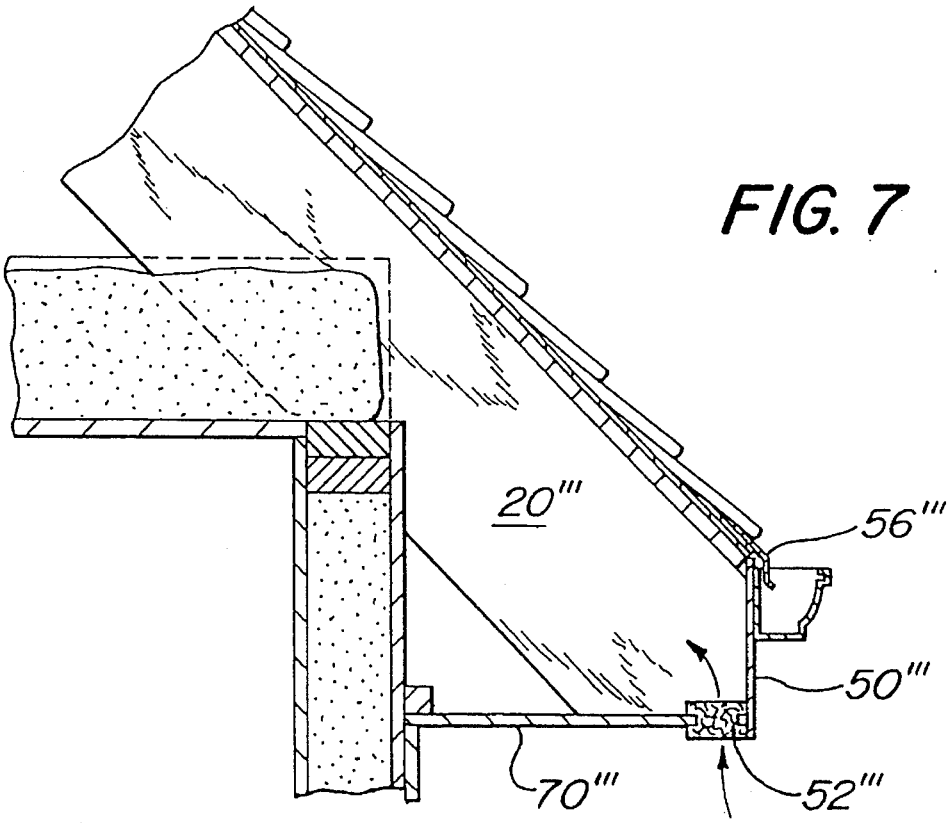
FIG. 7 is a vertical section of a portion of a house similar to FIG. 4 showing the alternative embodiment of FIG. 6.
Figure 8:
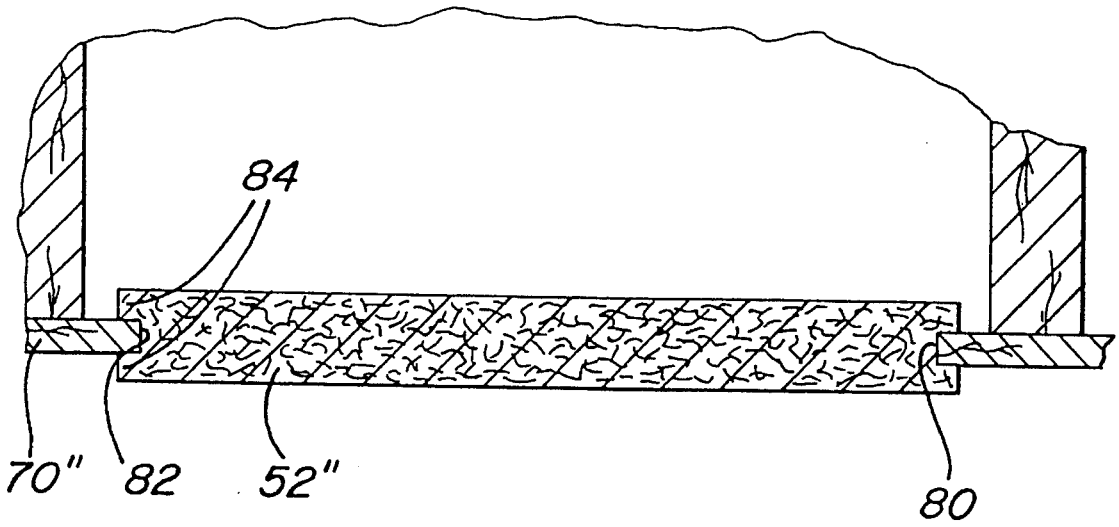
FIG. 8 is a second vertical section of a portion of the house showing the alternative embodiment of FIG. 6.

Referring to FIGS. 6 and 7, a fourth preferred embodiment is shown for a building structure of the type which has roof eaves, and thus both a soffit 70''' and a fascia 50'''. The fascia 50''' is wood and secured by conventional means. Oval shaped openings 80 are cut in the soffit 70'''. In a preferred embodiment, the openings 80 are of a size of approximately 11 inches on the major axis and 2 inches in the minor axis. An air permeable and resilient strip 52''' is shaped to fit in the opening 80. The strip 52''' is a single piece of non-woven material having an oval shape. The strip 52''' is formed or cut such that a central portion 82 is recessed, as best seen in FIG. 8. The center recess portion 82 is the same size as the opening 80 in the soffit 70'''. The strip 52''' has an upper and lower portions 84 which are larger than the opening 80.

To install the strip 52''', the opening 80 is cut in the soffit 70'''. The strip 52''' is compressed slightly so that the upper portion 84 is fed through the opening 80. Upon releasing the strip 52''', the air permeable and resilient strip 52''', being resilient, expands filling the opening 80, with the upper and lower portions 84 limiting movement of the strip 52'''. The strip 52''' can extend upward several inches above the soffit 70''' to reduce likelihood of insulation 28''' blocking ventilation.

Figure 9:
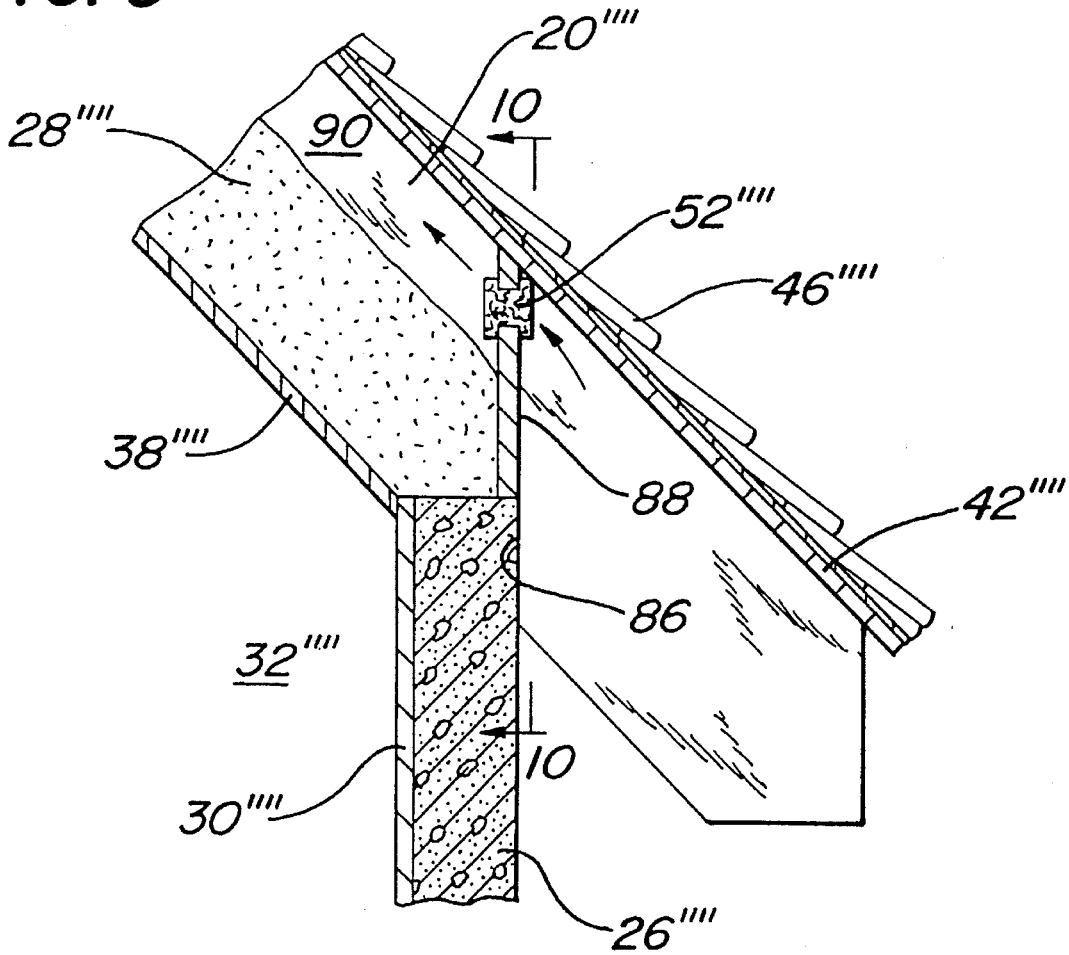
FIG. 9 is a vertical section of a portion of a house showing a fourth alternative embodiment.
Figure 10:
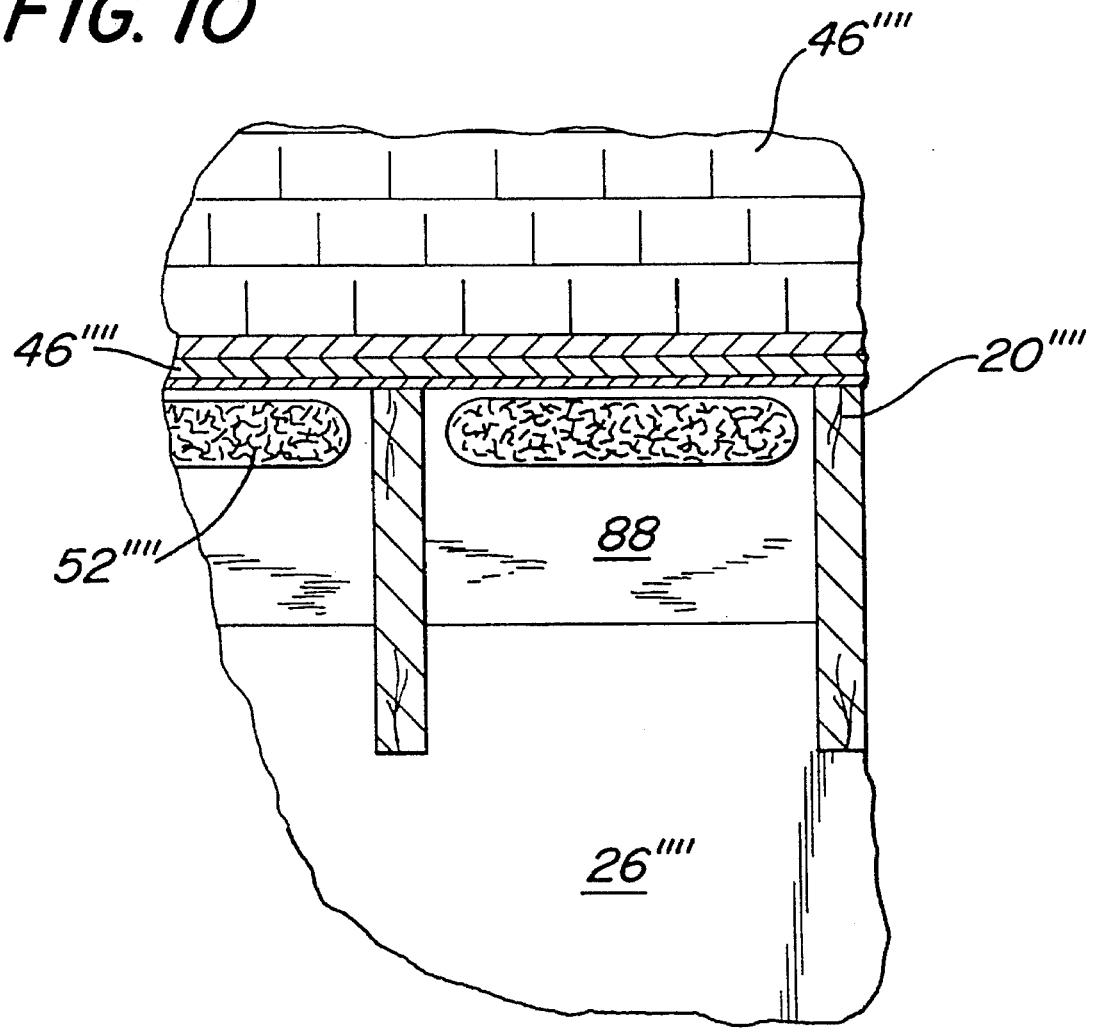
FIG. 10 is a vertical section taken along the line 10—10 of FIG. 9.

Referring to FIGS. 9 and 10, a fifth preferred embodiment is shown for a building structure of the type which has roof or rafters 28'''' extending beyond the vertical wall 26''''. The vertical wall 26'''' shown is a cement wall that supports the roof rafters 28'''' by a notch 86 cut in the rafter receiving the upper end of the vertical wall 26''''. The building structure 10'''' has an interior 32'''' defined by the plaster wall 30'''' and a ceiling 38''''. The ceiling 38'''' is attached directly to the roof rafters 28'''' and a layer of insulation 28'''' overlies the ceiling 38''''. Between the layer of insulation 28'''' and the roof sheathing 42'''' is a space 90 to allow air flow. Extending from the vertical wall 26'''' to the roof sheathing 42'''' between the roof rafters 28'''' is a series of fascia boards 88. The fascia boards 88 each have an oval shaped opening 80'''' cut into them. In a preferred embodiment, the openings 80'''' are of a size of approximately 15 inches in length along the major axis and 2 inches in the minor axis. An air permeable and resilient strip 52'''' is shaped to fit in the opening 80''''. As in the previous embodiment, the strip 52'''' is a single piece of non-woven material formed or cut such that a central portion 82'''' is recessed. The center recess 82'''' is the same size as the opening 80'''' in the fascia board 88. The strip 52'''' has a pair of side portions 84'''' which are larger than the opening 80. The opening 80'''' is positioned in the fascia board 88 such that the air permeable and resilient strip 52'''' is positioned above the insulation 20'''' and not seen from the exterior unless the person viewing is under the overhang of the rafter 20''''. As indicated previously, the non-woven material 52'''' can be colored to blend with the fascia board 88.

The present invention may be embodied in other specific forms without departing from the spirit or central attributes thereof and, accordingly, reference should be made to the appended claims, rather than to the foregoing specification, as indicating the scope of the invention. The building structures described had a wall constructed of studs or masonry. It is recognized that the wall could be built of other constructions such as block.

I claim:

1. A building structure adapted to allow for ventilation of vapors from within the structure so as to retard deterioration of the structure, comprising:

a roof extending over one or more side walls;

an attic space enclosed between the roof and an internal ceiling;

the roof being constructed on a plurality of rafters, the rafters being supported by the side wall;

a fascia secured to the outer ends of the roof rafters and at least one portion of the fascia spaced from the outer ends of the rafters; and an air permeable and resilient strip interposed between the fascia and the outer ends of the rafters, the air permeable and resilient strip including an upper surface and a side surface exposed to the attic space to provide for the flow of vapor therebetween and to the attic through the upper and side surfaces of the air permeable and resilient strip.

2. A building structure as in claim 1 further comprising an insulation material between the roof rafters and wherein the air permeable and resilient strip is positioned outboard of the insulation material.

3. A building structure as in claim 1 further comprising a roof sheathing member overlying the roof rafters, a drip gutter overlying the fascia and a portion of the roof sheathing, and a gutter secured to the fascia and the drip gutter extending into the gutter.

4. A building structure as in claim 3 further comprising an insulation material between the roof rafters and wherein the air permeable and resilient strip is positioned outboard of the insulation material.

5. A building structure as in claim 4 wherein the sidewall including a top plate and the outer ends of the roof rafters overly the top plate.

6. A building structure as in claim 4 further comprising a soffit interposed between the side wall and the fascia and underlying the roof rafters wherein the air permeable and resilient strip is interposed between the soffit and the fascia.

7. A building structure as in claim 6 wherein the roof rafters each have a notch for receiving the air permeable and resilient strip.

8. A building structure adapted to allow for ventilation of vapors from within the structure so as to retard deterioration of the structure, comprising:

a sloping roof extending upward over one or more vertical side walls, an attic space enclosed between the roof and an internal ceiling, the ceiling being constructed on a plurality of parallel joists and the roof being constructed on a plurality of parallel rafters, the joists and rafters supported by a top plate capping each vertical side wall, and the roof having a roof sheathing member overlying the roof rafters;

a fascia secured to the outer ends of the roof rafters and at least one portion of the fascia spaced from the outer ends of the rafters; and an air permeable and resilient strip interposed between the fascia and the outer ends of the rafters to provide for the flow of vapors therebetween and to the attic.

9. A building structure as in claim 8 further comprising an insulation material between the roof rafters and wherein the air permeable and resilient strip is positioned outboard of the insulation material.

10. A building structure as in claim 9 further comprising a drip gutter overlying the fascia and a portion of the roof sheathing.

11. A building structure as in claim 10 further comprising a gutter secured to the fascia and the drip gutter extending into the gutter.

12. A building structure as in claim 11 wherein the outer ends of the roof rafters overlie, s the top plate.

13. A building structure as in claim 11 further comprising a soffit interposed between the top plate and the fascia and underlying the roof rafters wherein the air permeable and resilient strip is interposed between the soffit and the fascia.

14. A building structure in accordance with claim 11, wherein the air permeable and resilient strip is a mat constructed of randomly aligned synthetic fibers which are open and blended, randomly aligned into a web by an airflow, joined by phenolic or latex binding agents and heat cured to produce a varying mesh, the mat being of unitary sheet construction having no dissimilar sheets laminated or otherwise bonded together.

15. A method of improving ventilation to a building structure, to allow for ventilation of vapors from within the structure so as to retard deterioration of the structure, comprising the steps of:

providing a sloping roof extending upward over one or more vertical side walls, an attic space enclosed between the roof and an internal ceiling, the ceiling being constructed on a plurality of parallel joists and the roof being constructed on a plurality of parallel rafters, the joists and rafters supported by a top plate capping each vertical side wall, and the roof having a roof sheathing strip overlying the roof rafters;

installing an air permeable and resilient strip against the roof rafter outer ends; and installing a fascia and at least one portion of the fascia spaced from the outer ends of the rafters wherein the air-permeable and resilient strip is interposed between the fascia and the outer ends of the rafters to provide for the flow of vapors therebetween and to the attic.

16. A method of improving ventilation to a building structure as in claim 15 further comprising the step of removing the fascia secured to the outer ends of the roof rafters prior to installing the air permeable and resilient strip.

17. A method of improving ventilation to a building structure as in claim 15 further comprising the steps of:

installing a rain gutter; and installing a drip edge over the roof sheathing and fascia into the rain gutter.

18. A method in accordance with claim 15, wherein the air permeable and resilient material is a mat constructed of randomly aligned synthetic fibers which are open and blended, randomly aligned into a web by a airflow, joined by phenolic or latex binding agents and heat cured to produce a varying mesh, the mat being of unitary sheet construction having no dissimilar sheets laminated or otherwise bonded together.

19. A method of improving ventilation to a building structure as in claim 15 wherein the step of installing an air permeable and resilient strip further comprising the step of cutting a notch in the roof rafters and installing the air permeable and resilient strip in the notch.

* * * * *